US008025039B2

(12) United States Patent
Iwata et al.

(10) Patent No.: US 8,025,039 B2
(45) Date of Patent: Sep. 27, 2011

(54) VALVE SPRING DEVICE AND VALVE TRAIN OF INTERNAL COMBUSTION ENGINE USING THE SAME

(75) Inventors: Kazuo Iwata, Yokohama (JP); Noritoshi Takamura, Yokohama (JP); Jun Tominaga, Yokohama (JP); Norihiro Tajima, Yokohama (JP); Takeshi Yabushita, Yokohama (JP)

(73) Assignee: NHK Spring Co., Ltd., Yokohama-Shi (JP)

( * ) Notice: Subject to any disclaimer, the term of this patent is extended or adjusted under 35 U.S.C. 154(b) by 129 days.

(21) Appl. No.: 12/539,871

(22) Filed: Aug. 12, 2009

(65) Prior Publication Data

US 2009/0293827 A1 Dec. 3, 2009

Related U.S. Application Data

(63) Continuation of application No. PCT/JP2008/052266, filed on Feb. 12, 2008.

(30) Foreign Application Priority Data

Feb. 15, 2007 (JP) ..... 2007-035213

(51) Int. Cl.
*F01L 3/10* (2006.01)

(52) U.S. Cl. ..... 123/90.65; 251/337

(58) Field of Classification Search ..... 123/90.65, 123/90.16, 90.48; 251/337
See application file for complete search history.

(56) References Cited

U.S. PATENT DOCUMENTS

| | | | |
|---|---|---|---|
| 4,957,076 A | | | 9/1990 Inoue et al. |

FOREIGN PATENT DOCUMENTS

| | | | |
|---|---|---|---|
| JP | 52-81178 | | 1/1979 |
| JP | 55-112008 | * | 8/1980 |
| JP | 60-77711 U | | 5/1985 |
| JP | 63-97811 A | | 4/1988 |
| JP | 4-284109 A | | 10/1992 |
| JP | 4-126043 U | | 11/1992 |
| JP | 5-33621 A | | 2/1993 |
| JP | 8-177422 A | | 7/1996 |
| JP | 2000-240705 A | | 9/2000 |
| JP | 2004-169730 A | | 6/2004 |

OTHER PUBLICATIONS

International Preliminary Report on Patentability and Written Opinion (in English) dated Aug. 27, 2009 issued in a counterpart International Application No. PCT/JP2008/052266.

* cited by examiner

*Primary Examiner* — Zelalem Eshete
(74) *Attorney, Agent, or Firm* — Holtz, Holtz, Goodman & Chick, PC

(57) ABSTRACT

A port is formed in a cylinder head of an engine. The port is opened and closed by a valve. A valve spring device is provided with a first spring and a second spring. The second spring is contained in a housing and held by a stopper in a manner such that it is compressed along an axis or subjected to a preload. The preload of the second spring is larger than an installation load of the first spring. An axial load acts on the springs. The valve spring device has load-deflection characteristics such that only the first spring deforms axially when the axial load is not larger than a predetermined value and that both the first and second springs deform axially when the axial is load exceeds the predetermined value.

9 Claims, 10 Drawing Sheets

VALVE SPRING DEVICE AND VALVE TRAIN OF INTERNAL COMBUSTION ENGINE USING THE SAME

CROSS REFERENCE TO RELATED APPLICATIONS

This is a Continuation Application of PCT Application No. PCT/JP2008/052266, filed Feb. 12, 2008, which was published under PCT Article 21(2) in Japanese.

This application is based upon and claims the benefit of priority from prior Japanese Patent Application No. 2007-035213, filed Feb. 15, 2007, the entire contents of which are incorporated herein by reference.

BACKGROUND OF THE INVENTION

1. Field of the Invention

The present invention relates to a valve spring device attached to an engine of, for example, an automobile and a valve train using the valve spring device.

2. Description of the Related Art

A valve train of an internal combustion engine (hereinafter referred to simply as the engine) includes an intake valve and an exhaust valve attached to a cylinder head, a valve spring, a cam mechanism, etc. The intake and exhaust valves serve individually to open and close ports in the cylinder head. The valve mechanism urges these valves in their closing direction. An installation load and a maximum load of the valve spring are set to suitable values such that the valves never undergo a jump or bounce when the engine is in high rotation. The jump is a phenomenon that a valve that is opened or closed at a high speed by a cam hops up above a predetermined valve opening position near the maximum lift of the valve. The bounce is a phenomenon that the valve is repelled by a valve seat and fails to maintain a fully closed state when it is closed as the cam rotates.

It is generally known that the valve spring causes surging if it is driven at a high speed when the engine is in high rotation. If the surging occurs, the load of the valve spring fluctuates. In some cases, the surging may cause the valve spring to deform in a direction to compress itself. A reduction of the load that is attributable to this phenomenon may bring about the jump or bounce. Thus, the maximum load of the valve spring is set to a relatively large value in consideration of the surging. The larger the load of the valve spring, however, the greater a friction loss of a valve train system is, so that the fuel efficiency of the engine may be worsened. Thus, the load of the valve spring is expected to be reduced.

A double-pitch coil spring has been proposed as a means to prevent an increase of surging. The double-pitch coil spring includes a small-pitch portion with small wire turn pitches and a large-pitch portion with large pitches. If any surging occurs, turns of the small-pitch portion closely contact one another, thereby restraining the surging to some extent.

In this double-pitch coil spring, however, both the small- and large-pitch portions may possibly vibrate to reduce the load, depending on the resonance frequency, when the surging increases. In such a case, the jump or bounce sometimes cannot be suppressed. In the double-pitch coil spring, moreover, a twisting vibration that is caused by the surging propagates from the large-pitch portion to the small-pitch portion. Thus, the double-pitch coil spring has a problem that its surging restraining effect is not large enough for a large surging, in particular.

An example of a valve spring device for surging prevention is described in Jpn. Pat. Appln. KOKAI Publication No. 2000-240705. This valve spring device is provided with a valve spring, formed of a compression coil spring, and an elastically deformable washer. The washer is located in series with the valve spring. A surging wave that is produced in the valve spring is absorbed by elastic deformation of the washer.

In the valve spring device described in the above patent document, the washer is compressed as the valve spring is compressed. Specifically, the washer starts to deform at an initial stage of a valve lift, and a deflection of the washer increases with an increase of that of the valve spring. If the valve spring undergoes any surging, therefore, the washer deforms in the direction of its compression. Thus, a force that presses the valve is reduced to cause a jump or bounce of the valve. If the spring constant of the valve spring is increased in order to enhance the force to press the valve, however, a friction loss of a valve train system increases, so that the fuel efficiency of an engine worsens.

BRIEF SUMMARY OF THE INVENTION

The object of the present invention is to provide a valve spring device, capable of restraining an increase of surging, suppressing a jump or bounce attributable to the surging, and reducing a load of a valve spring, and a valve train of an engine using the same.

The present invention is a valve spring device which urges a valve attached to a port in a closing direction. The valve spring device comprises a first spring, formed of a compression coil spring and deformable along the axis of the valve, and a second spring disposed in series with the first spring and held by a stopper in a manner such that the second spring is subjected to a preload by axial compression, the preload of the second spring being larger than an installation load of the first spring and the valve spring device having load-deflection characteristics such that only the first spring deforms axially when an axial load which acts in a direction to compress the first spring is not larger than a predetermined value and that the first and second springs deform axially when the axial load exceeds the predetermined value.

In the valve spring device of the invention, the second spring is pre-compressed as it is held within a predetermined extension-side stroke by the stopper. In other words, the preload is applied to the second spring. The second spring cannot be compressed unless the first spring is compressed by a load that exceeds the preload. Therefore, the valve spring device, a valve train system, has an increased natural frequency, so that it can display a surging restraining effect.

According to the invention, the occurrence of surging can be restrained. If any surging occurs, turns of a wire of the first spring contact one another in a region where the first spring jumps. Accordingly, a reduction of a load that may cause a jump can be prevented, so that the occurrence of a jump or bounce can be suppressed. Thus, the surging can be immunized. Since the load of the valve spring can be reduced, moreover, a friction loss of the valve train system can be lessened.

In an aspect of the invention, a wire of the first spring includes portions which contact one another when the predetermined value is exceeded by the axial load. Only the first spring deforms axially when the axial load is not larger than the predetermined value, and both the first and second springs deform axially when the axial load exceeds the predetermined value.

In the case where at least some turns of the wire of the first spring are brought into contact with one another by the axial load, the wire of the first spring should preferably has an oval cross section. Further, the wire may have flat surface portions which contact one another.

The preload of the second spring may be set so that the second spring deforms axially when the axial load exceeds a load under which all turns of the wire of the first spring closely contact one another. In this case, the second spring is compressed when the first spring is compressed so that all the turns closely contact one another. Thus, a greater surging restraining effect can be displayed.

A valve train according to the invention, which is provided with the valve spring device described above, comprises a valve including a valve disc for opening and closing a port formed in a cylinder head, a drive mechanism which drives the valve in an opening direction by means of a rotating cam, and the valve spring device which drives the valve in a closing direction, the drive mechanism having a function to deform only the first spring axially and a function to deform both the first and second springs axially.

In the valve train of the invention, the drive mechanism may include a camshaft which rotates as an engine rotates and means for changing a lift of the valve in accordance with an output of the engine.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
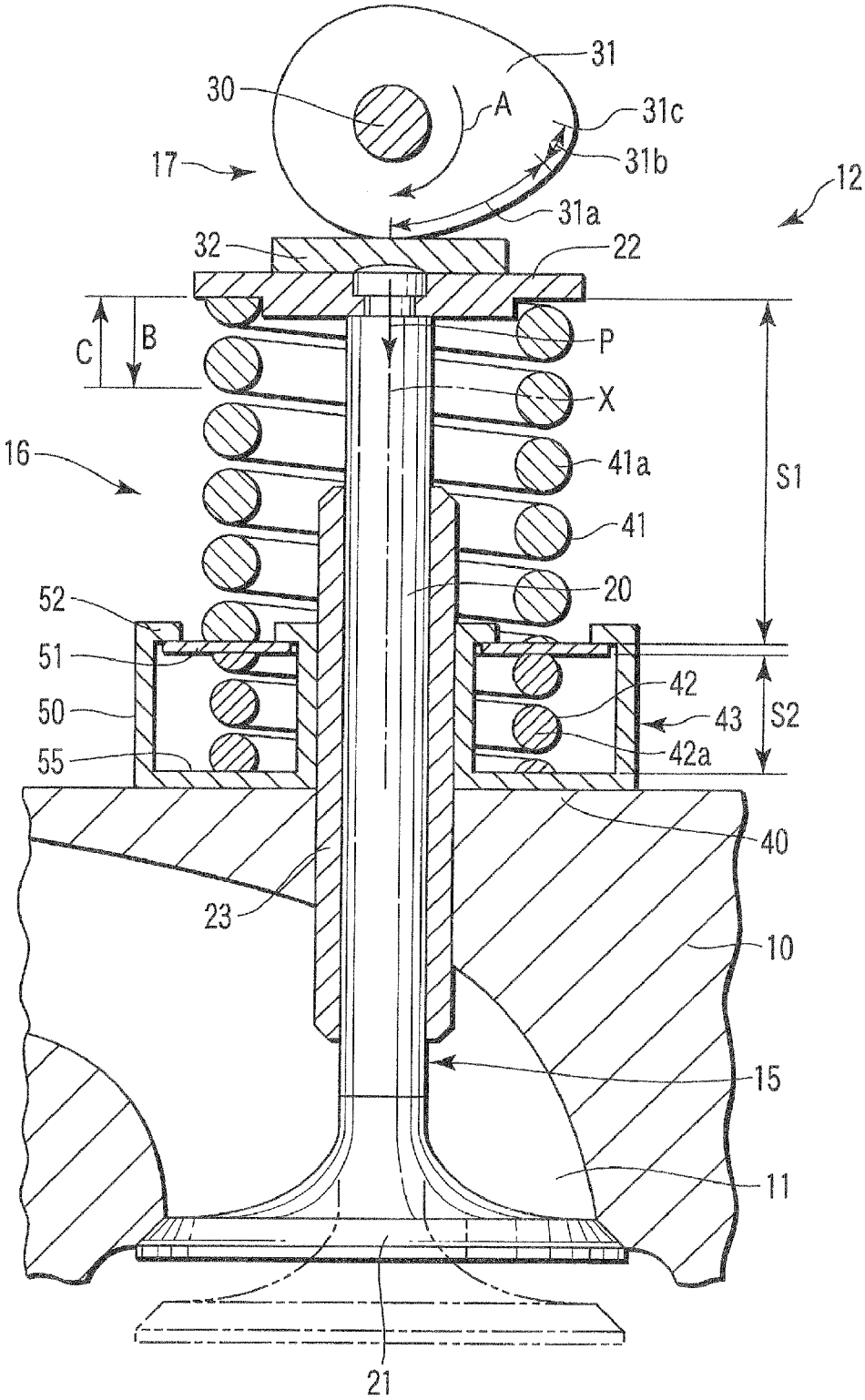
FIG. 1 is a sectional view of a valve train provided with a valve spring device according to a first embodiment of the invention.

A valve spring device according to a first embodiment of the present invention will now be described with reference to FIGS. 1 and 2. An intake port 11 is formed in a cylinder head 10 of an engine. The cylinder head 10 is provided with an intake valve train 12. The valve train 12 includes an intake valve 15, a valve spring device 16, a drive mechanism 17, etc. The intake valve 15 opens and closes the intake port 11. The drive mechanism 17 urges the intake valve 15 in its closing direction.

The cylinder head 10 is provided with an exhaust valve train (not shown) for opening and closing an exhaust port (not shown). Since the exhaust valve train is constructed substantially in the same manner as the intake valve train 12, its description is omitted here, and the intake valve train 12 will be described as a representative.

The valve (intake valve) 15 that is attached to the intake port 11 is provided with a shaft 20 having an axis X, a valve disc 21 for opening and closing the intake port 11, a spring retainer 22 as a spring receiving member, etc. The retainer 22 is mounted on an end portion of the shaft 20. The shaft 20 extends along axis X. The shaft 20 is set in a cylindrical valve guide 23. The valve guide 23 is disposed in the cylinder head 10. The shaft 20 can reciprocate together with the spring retainer 22 along axis X.

The drive mechanism 17 includes a camshaft 30, a cam 31 mounted on the camshaft 30, and a transmission member 32. The transmission member 32 is located between the valve 15 and the cam 31. The cam 31 rotates as a crankshaft (not shown) of the engine rotates. The cam 31 rotates in the direction indicated by arrow A in FIG. 1 around the camshaft 30.

The valve 15 moves as the cam 31 rotates in the direction of arrow A. The valve 15 is reciprocated along axis X by the transmission member 32. An alternative form of the drive mechanism 17 may be provided with a rocker arm (not shown) that is driven by a cam. The rocker arm can reciprocate the valve 15 along axis X. In this case, the rocker arm functions as a transmission member.

The valve spring device 16 is located between a spring retainer portion 40 and the spring retainer 22. The retainer portion 40 is a part of the cylinder head 10. The valve spring device 16 includes a first spring 41 and a second spring 42 that are formed of a compression coil spring each. The second spring 42 and a housing 50 constitute a pre-compressed spring unit 43.

The first spring 41 functions as a first valve spring. The first spring 41 is located compressed between the spring retainer 22 and the pre-compressed spring unit 43. The length of the first spring 41 in an installed state such that it is not pressed by the drive mechanism 17 is designated by S1. An installation load of the first spring 41 with the length S1 is a reaction force that is generated along axis X. The spring retainer 22 is subjected to an axial load P by the drive mechanism 17 in a direction such that the first spring 41 is compressed. The axial load P is a load that acts along axis X.

The pre-compressed spring unit 43 includes the second spring 42, the housing 50 that contains the second spring 42, a movable spring seat 51, etc. The second spring 42 functions as a second valve spring. The first and second springs 41 and 42 are arranged in series with each other along axis X. The movable spring seat 51 is held in the housing 50 for movement along axis X. A stopper 52 is formed at an end portion of the housing 50. The stopper 52 prevents the movable spring seat 51 from jumping out of the housing 50.

The second spring 42 is located pre-compressed between the movable spring seat 51 and a bottom wall 55 of the housing 50. Thus, the second spring 42 is subjected to a preload when it is held in the housing 50. The second spring 42 is prevented by the stopper 52 from extending beyond a predetermined length S2 along axis X. The preload applied to the second spring 42 is larger than the installation load of the first spring 41. The load-deflection characteristics of the first and second springs 41 and 42 are characteristics such that only the first spring 41 deforms along axis X when the axial load P is not larger than a predetermined value and that both the first and second springs 41 and 42 deform along axis X when the axial load P exceeds the predetermined value.

The preload of the second spring 42 is larger than the axial load P under which at least some turns of a wire 41*a* of the first spring 41 contact one another. Alternatively, the reload is larger than the axial load P that is applied immediately before all turns of the wire 41*a* of the first spring 41 closely contact one another. When the axial load P is small, therefore, only the first spring 41 is compressed and deforms along axis X. The second spring 42 deforms along axis X after almost all turns of the wire 41*a* of first spring 41 contact one another as the axial load P increases.

The cam 31 has a first cam surface 31*a* and a second cam surface 31*b* that adjoin each other in the rotational direction of the cam 31. When the cam 31 rotates in the direction of arrow A, the first cam surface 31*a* causes only the first spring 41 to deform along axis X before at least some turns of the wire 41*a* of the first spring 41 contact one another. After some turns of the wire 41*a* of the first spring 41 contact one another, the second cam surface 31*b* further drives the valve 15 in its fully opening direction, thereby causing the first and second springs 41 and 42 to deform along axis X.

The diameter of a wire 42*a* of the second spring 42 of the present embodiment is smaller than that of the wire 41*a* of the first spring 41. In contrast with this, however, the diameter of the wire 42*a* of the second spring 42 may be made larger than that of the wire 41*a* of the first spring 41. The diameter of the wire 41*a* of the first spring 41 may be equal to the diameter of the wire 42*a* of the second spring 42. In short, the second spring 42 never deforms along axis X before the deflection of the first spring 41 along axis X reaches a predetermined value as the axial load P is applied by the cam 31. When the deflection of the first spring 41 exceeds the predetermined value, the second spring 42 also deforms along axis X. The load-deflection characteristics of the valve springs 41 and 42 are set in this manner.

The following is a description of the operation of the valve train 12 that is provided with the valve spring device 16 of the present embodiment.

When the engine rotates, the cam 31 of the drive mechanism 17 rotates in the direction of arrow A in FIG. 1 in association with the crankshaft. As the cam 31 rotates, the shaft 20 and the disc 21 of the valve 15 move through the medium of the transmission member 32. Thus, the valve disc 21 moves in the direction to open the intake port 11.

Specifically, the cam 31 in the state shown in FIG. 1 rotates in the direction of arrow A. As this is done, the first cam surface 31*a* presses the transmission member 32, whereupon the valve 15 moves in the direction of arrow B. Thus, the first spring 41 is compressed. The first cam surface 31*a* compresses only the first spring 41 before at least some turns of the wire 41*a* of the first spring 41 contact one another.

Figure 2:
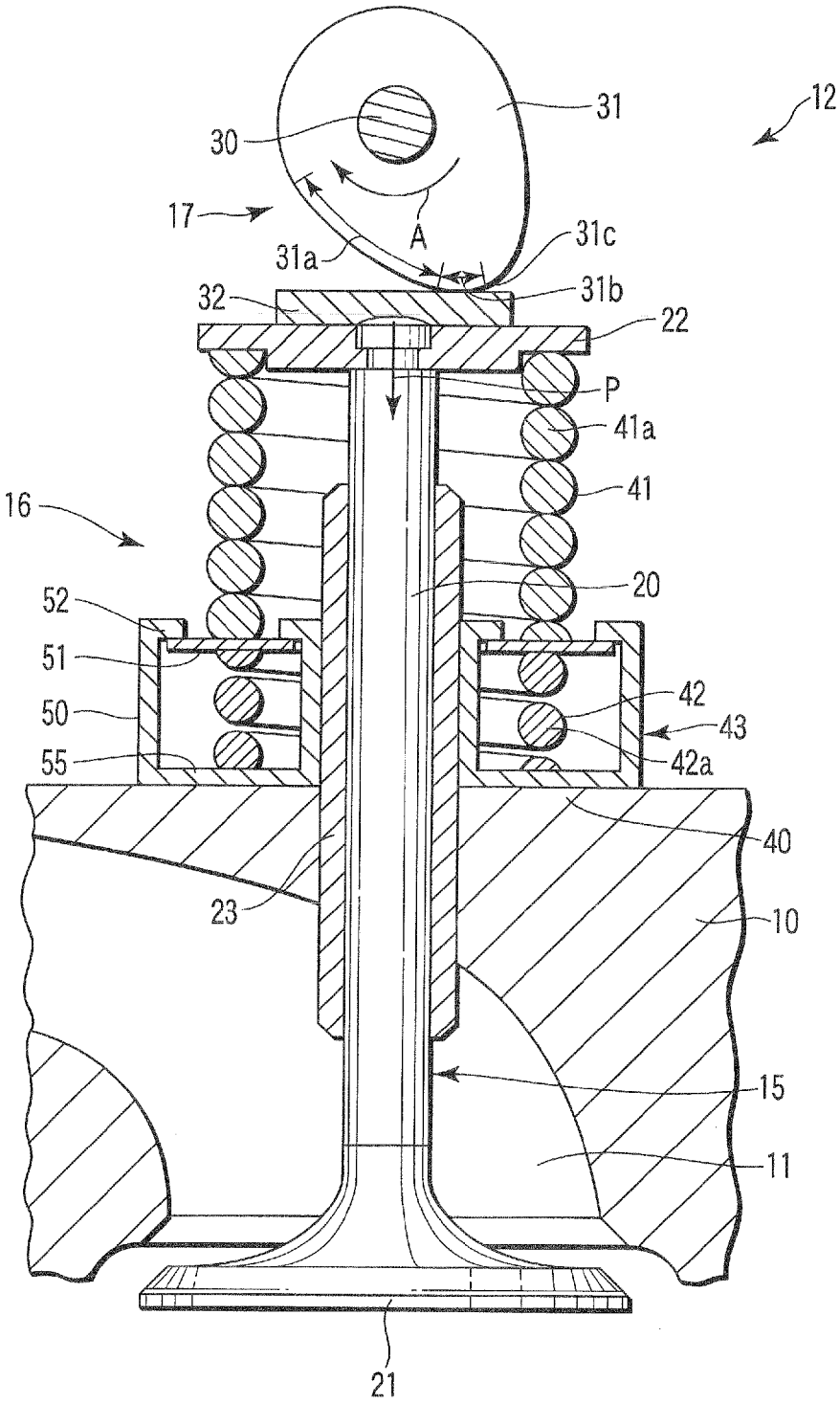
FIG. 2 is a sectional view showing a state in which a valve of the valve train shown in FIG. 1 is moved in an opening direction.

When the first spring 41 is compressed, as shown in FIG. 2, at least some turns of the wire 41*a* of the first spring 41 contact one another. Thereupon, the load (reaction force) of the first spring 41 sharply increases, so that the second spring 42 starts to be compressed. Thus, the second spring 42 is compressed even when all turns of the wire 41*a* of the first spring 41 closely contact one another, so that the valve 15 is allowed to move in the fully opening direction (toward a maximum lift position).

As the cam 31 further rotates in the direction of arrow A from the position shown in FIG. 2, the second cam surface 31*h* presses the transmission member 32. Thereupon, the valve 15 further moves in a valve opening direction. When a top portion 31*c* of the cam 31 presses the valve 15, the valve reaches the maximum, lift position.

When the valve 15 passes the maximum lift position, the second spring 42 extends, so that the movable spring seat 51 hits the stopper 52. Accordingly, the second spring 42 is kept extended to the length S2 (shown in FIG. 1). When the valve 15 moves in a valve closing direction (indicated by arrow C in FIG. 1), the first spring 41 returns to the initial installation position, and the valve 15 is fully closed.

When the engine is operated at a high rotational frequency, the first spring 41 vibrates at a high speed along axis X, so that surging may possibly occur. If the first spring 41 undergoes any surging, the turns of the wire 41*a* of the spring 41 contact one another during a lift of the valve 15, so that a displacement of the spring 41 in the compression direction (or along axis X) can be arrested. Accordingly, a reduction of a load that presses the valve 15 can be restrained, so that the occurrence of a jump or bounce of the valve 15 can be suppressed. Thus, the surging can be immunized.

The valve spring device 16 according to the present embodiment is disposed with its second spring 42 reloaded. In the valve spring device 16, the turns of the wire 41*a* of the first spring 41 contact one another when the valve 15 is near the maximum lift position in which it has a maximum inertial force. Accordingly, the load of the valve spring device 16 can be suddenly changed when the valve 15 is in the maximum lift position. Thus, the load of the valve 15 can be reduced throughout the entire lift stroke.

In the valve spring device 16 of the present embodiment, moreover, the first and second springs 41 and 42 are separated along axis X. Therefore, a twisting vibration of the first spring 41 that is caused by surging can be prevented from propagating into the second spring 42. Accordingly, the load of the valve spring device 16 is stabilized when the valve 15 is near the maximum lift position with the maximum inertial force. Thus, the load of the first spring 41 can be set lower than that of a conventional valve spring, so that a friction loss can be reduced.

Since the turns of the wire 41*a* of the first spring 41 contact one another during the lift of the valve 15, moreover, the stress amplitude of the first spring 41 can be restricted to a low level. Thus, the first spring 41 is improved in durability, so that its effective number of turns can be reduced.

As described above, the valve spring device 16 of the present embodiment can restrain an increase of surging. If any surging occurs, the jump or bounce of the valve 15 can be suppressed, so that the surging can be immunized. Further, the load of the valve spring device 16 can be made smaller than that of the conventional double-pitch coil spring or the conventional valve spring device described in the aforementioned patent document. Thus, a friction loss of the valve train can be reduced, so that the fuel efficiency and output of the engine can be enhanced.

Figure 3:
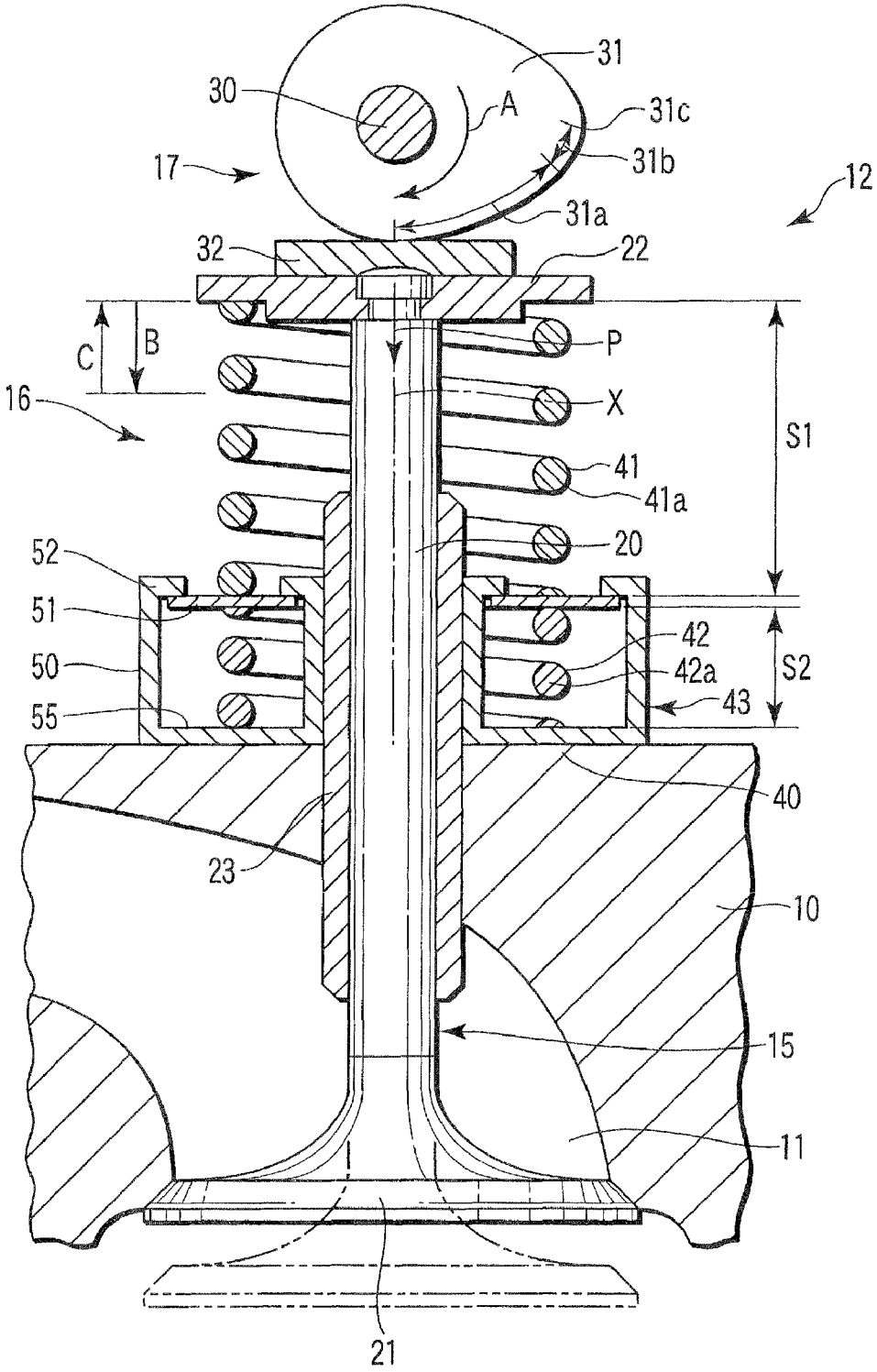
FIG. 3 is a sectional view of a valve train provided with a valve spring device according to a second embodiment of the invention.
Figure 4:
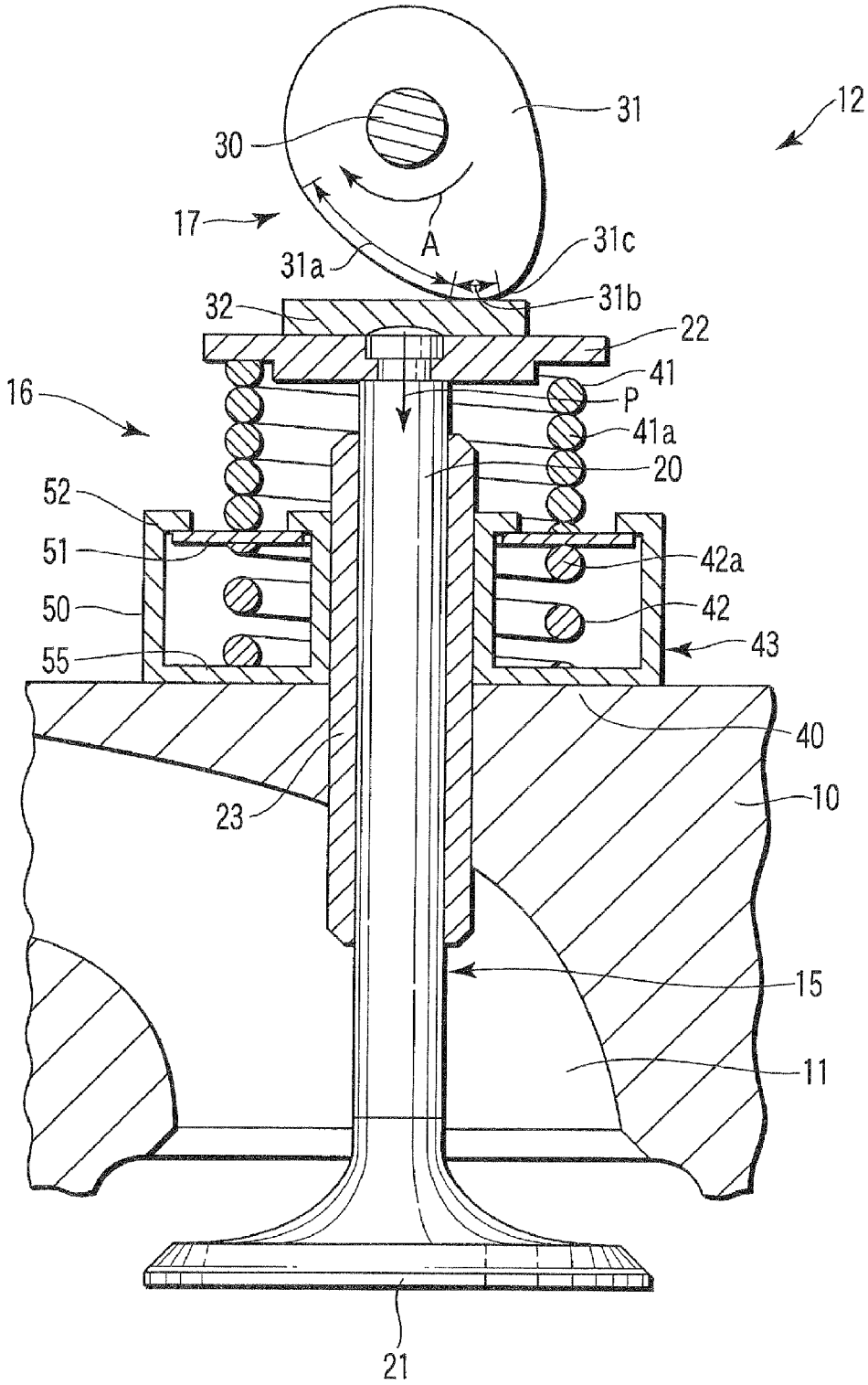
FIG. 4 is a sectional view showing a state in which a valve of the valve train shown in FIG. 3 is moved in an opening direction.

FIGS. 3 and 4 show a valve train 12 according to a second embodiment of the invention. A valve spring device 16 of this valve train 12 also includes a first spring 41 and a second spring 42 or a pre-compressed spring. A wire 41*a* of the first spring 41 and a wire 42*a* of the second spring 42 are equal in diameter. Since other configurations and functions of the valve train 12 of the present embodiment are the same as those of the valve train 12 of the first embodiment shown in FIGS. 1 and 2, common numerals are used to designate common portions of the two valve trains, and a repeated description of those portions is omitted.

Figure 5:
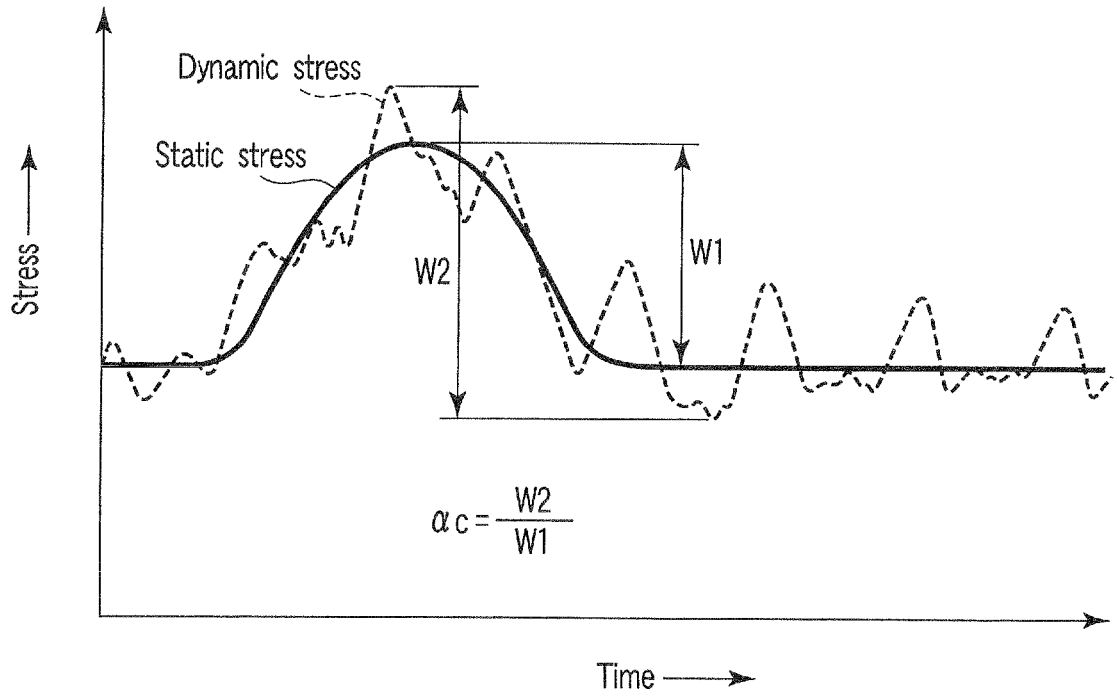
FIG. 5 is a diagram showing the relationship between time and stress established when a valve spring is compressed.

FIG. 5 shows the relationship between a time duration in which a conventional valve spring is compressed by a rotating cam and stresses that are generated at a moving end of the valve spring. When a camshaft rotates at a low speed, a static stress is generated in the manner indicated by a solid line in FIG. 5. The static stress changes in a smooth curve. When the camshaft rotates at a high speed, a dynamic stress is generated as indicated by a broken line. The dynamic stress fluctuates drastically, and its maximum amplitude is larger than that of the static stress. Here let us suppose that W1, W2 and $\alpha_C$=W2/W1 are a static stress amplitude, a dynamic stress amplitude, an amplitude ratio, respectively. As the rotation of the camshaft becomes higher, the dynamic stress is correspondingly increased by surging, so that the value $\alpha_C$ becomes larger.

Figure 6:
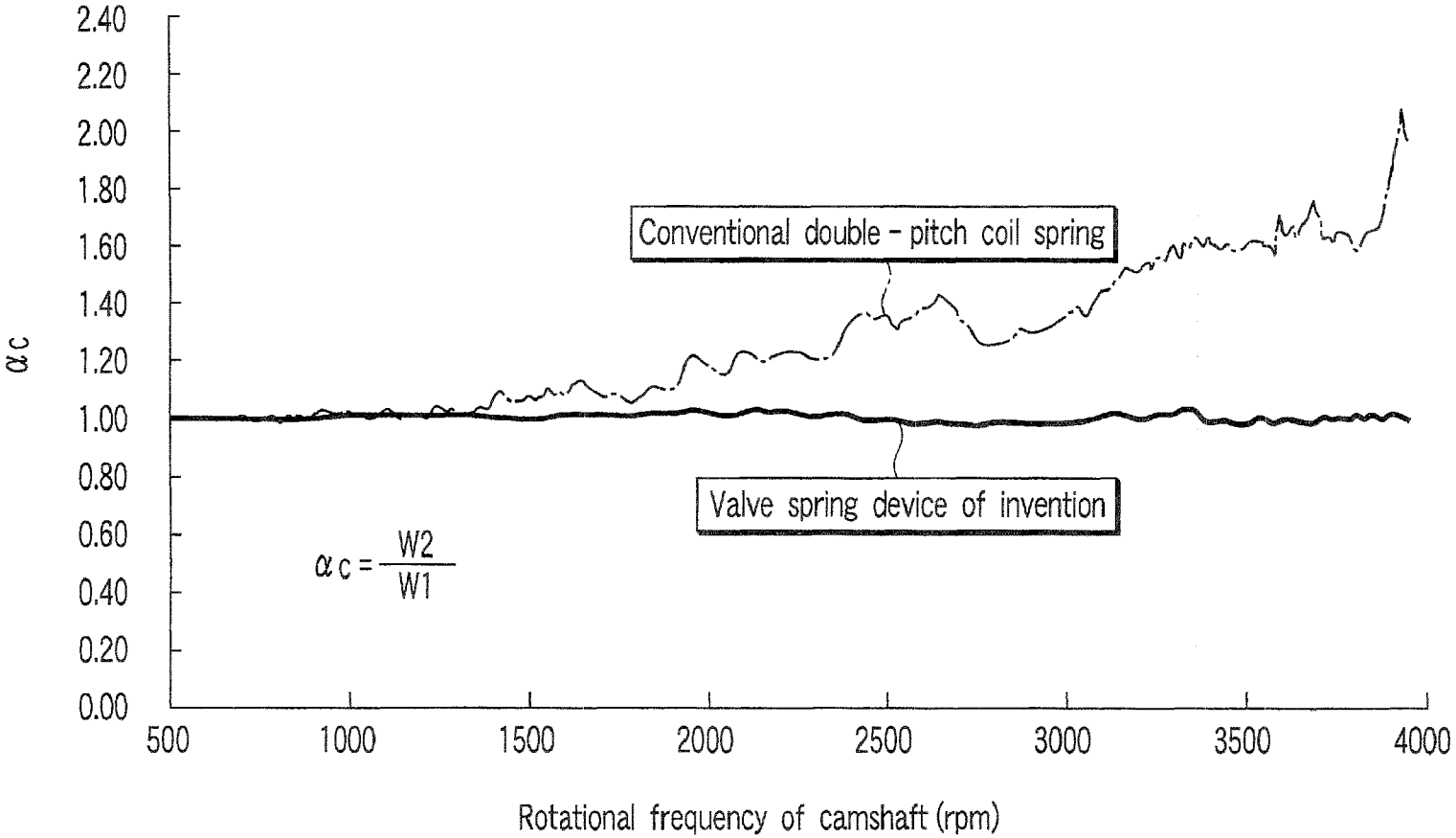
FIG. 6 is a diagram showing the relationship between the rotational frequency of a camshaft of the valve train shown in FIG. 3 and a value $\alpha_C$.

FIG. 6 shows the result of comparison between the first spring 41 of the valve spring device 16 according to the present invention and the conventional double-pitch coil spring with respect to the value $\alpha_C$. In the valve spring device 16 of the invention, the value $\alpha_C$ can be kept substantially at 1 even when the rotational frequency of the camshaft is nearly 4,000 rpm. In the conventional double-pitch coil spring, on the other hand, the value $\alpha_C$ increases with the increase of the rotational frequency of the camshaft, and it reaches 2 or more when the rotational frequency is near 4,000 rpm.

Figure 7:
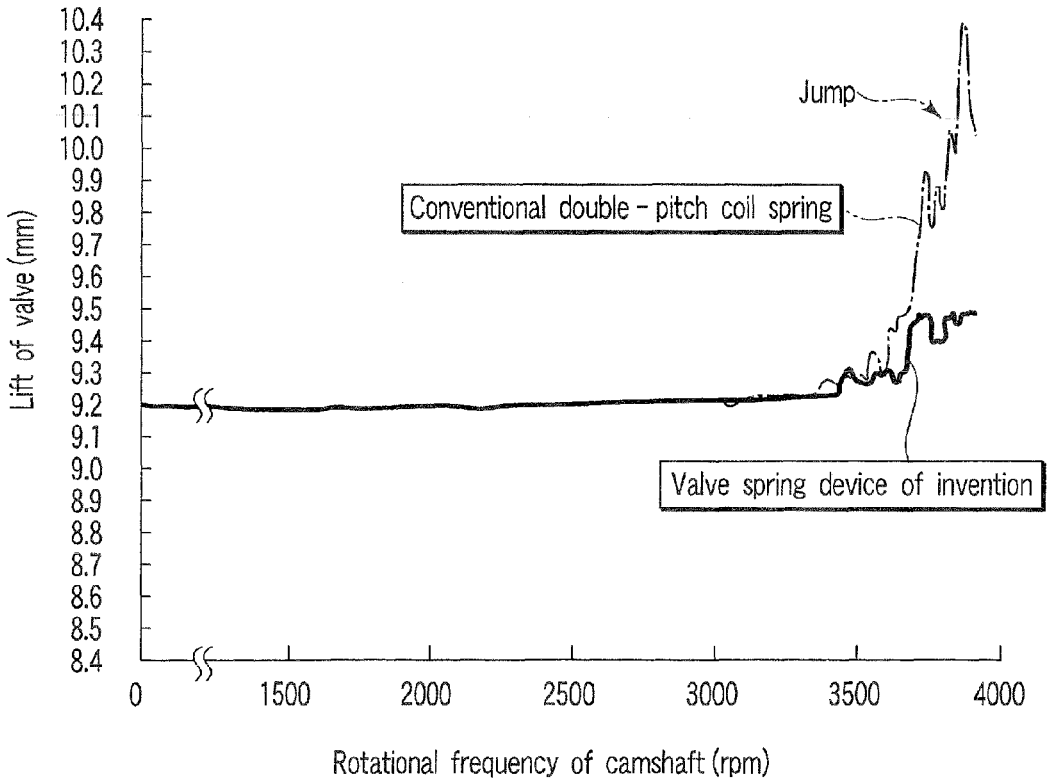
FIG. 7 is a diagram showing the relationship between the rotational frequency of the camshaft of the valve train shown in FIG. 3 and a lift of the valve.

FIG. 7 shows the relationship between the rotational frequency of the camshaft and the lift of the valve based on comparison between the valve spring device 16 according to the present invention and the conventional double-pitch coil spring. In the valve spring device 16 of the invention, a jump of 0.5 mm or more is not caused even when the rotational frequency of the camshaft exceeds 3,500 rpm. In the conventional double-pitch coil spring, on the other hand, a jump of 0.5 mm or more is caused when the rotational frequency of the camshaft exceeds 3,500 rpm, that is, an operating limit is reached by the valve train.

Figure 8:
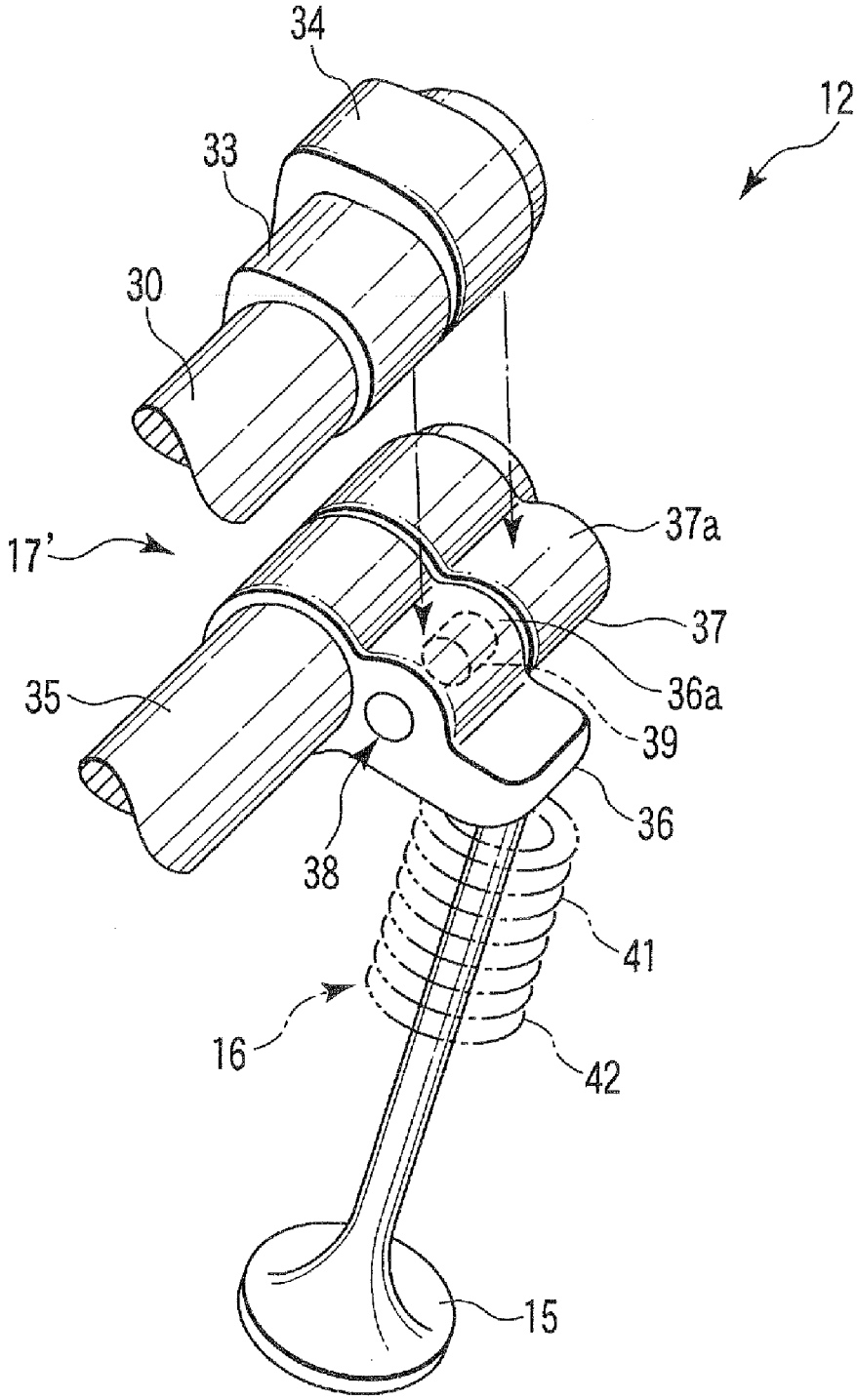
FIG. 8 is a perspective view of a valve train according to a third embodiment of the invention.
Figure 9:
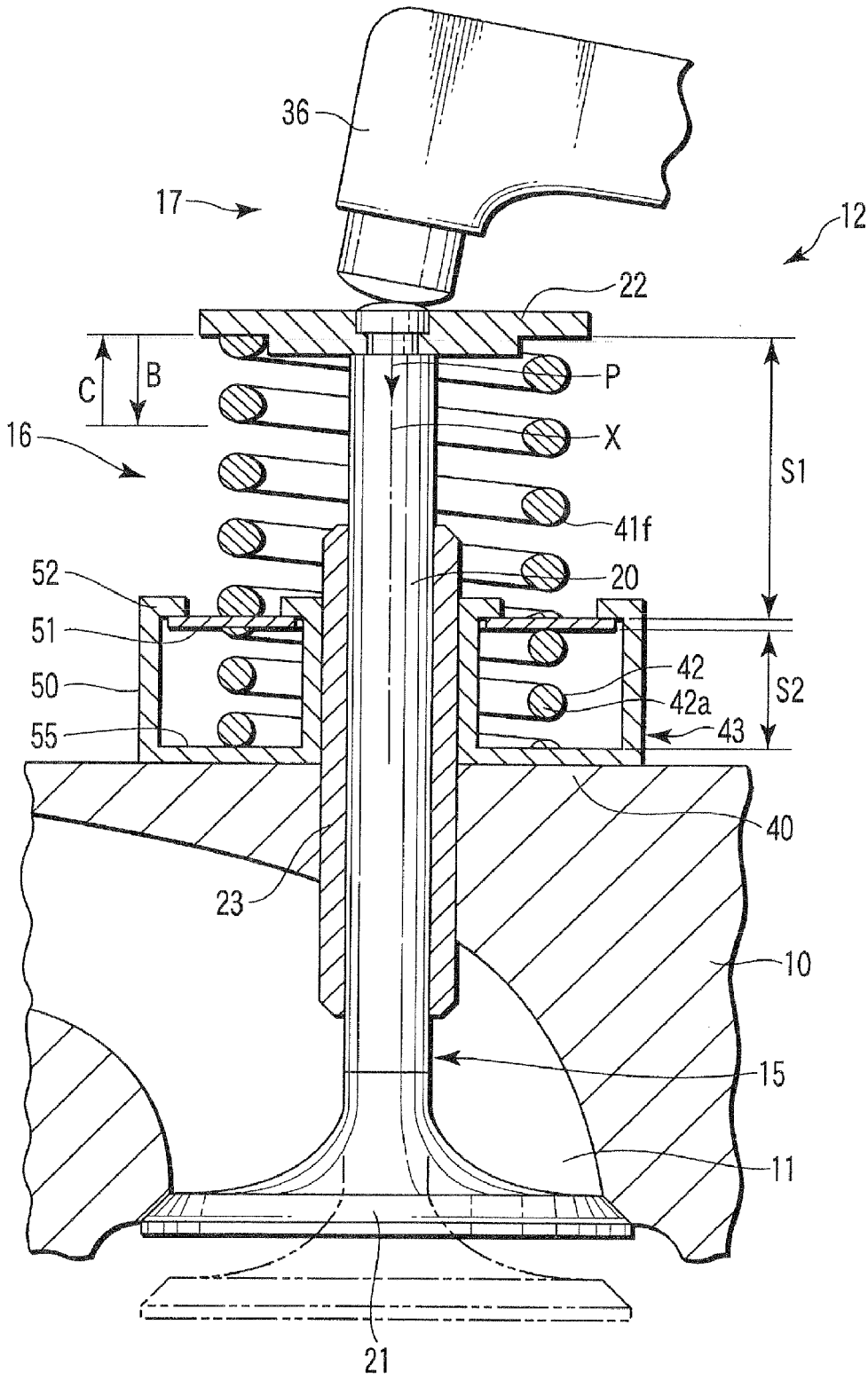
FIG. 9 is a sectional view of the valve train shown in FIG. 8.

FIGS. 8 and 9 show a valve train 12 according to a third embodiment of the invention. This valve train 12 is provided with a variable drive mechanism 17', which can vary the lift of a valve 15 in accordance with the engine output. An example of the variable drive mechanism 17' includes a first cam 33 for low-output operation and a second cam 34 for high-output operation on a camshaft 30, first and second rocker arms 36 and 37 on the rocker shaft 35 and switching means 38. The first rocker arm 36 is provided with a first cam follower 36*a* that is abutted by a cam surface of the first cam 33. The second rocker arm 37 is provided with a second cam follower 37*a* that is abutted by a cam surface of the second cam 34.

The switching means 38 is provided with a switching member 39 that is movable between first and second positions. The switching member 39 is driven by oil hydraulic pressure, for example. When the engine is in the low-output operation, the switching member 39 is situated in the first position where the first and second rocker arms 36 and 37 are disengaged from each other. During the low-output operation, therefore, the first rocker arm 36 is driven by the first cam 33, and the lift of the valve 15 is small.

For the high-output operation of the engine, the switching member 39 moves to the second position. When the switching member 39 moves to the second position, the first and second rocker arms 36 and 37 are connected to each other. During the high-output operation, therefore, the rotation of the second cam 34 is transmitted to the first rocker arm 36 through the second rocker arm 37, so that the lift of the valve 15 increases. The variable drive mechanism 17' may be constructed in any other suitable way.

Figure 10:
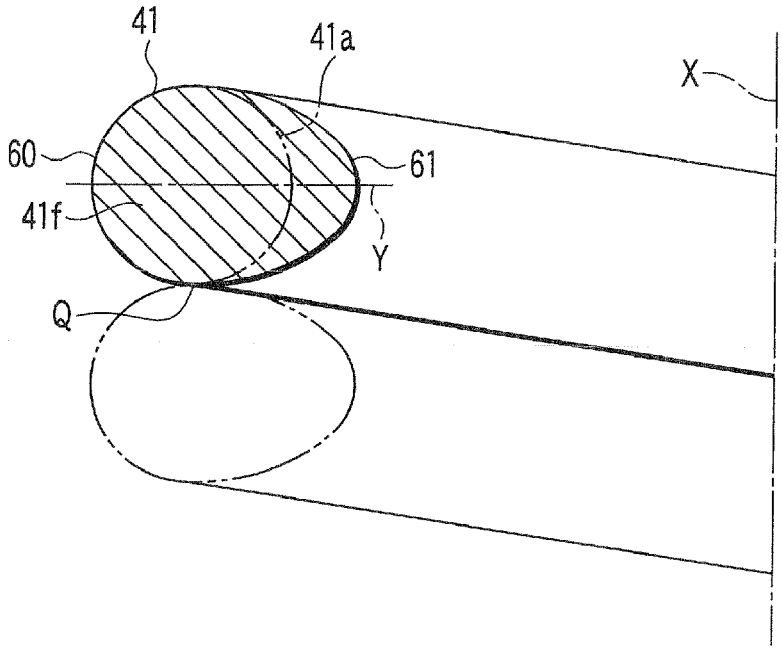
FIG. 10 is a sectional view of a wire of a first spring of a valve spring device shown in FIG. 9.

In the valve train 12 with the variable drive mechanism 17' described above, only a first spring 41 that has a small spring constant is compressed by the first cam 3 during the low-output operation of the engine. Accordingly, the load of a valve spring device 16 can be made smaller, so that a friction loss can be further reduced. Thus, the fuel efficiency and output of the engine can be enhanced. The first spring 41 and a second spring 42 can be compressed by the second cam 34 only when the engine is in the high-output operation. Preferably, the cross section of a wire 41*f* of the first spring 41 should be oval, as shown in FIG. 10. The cross section of the wire 41*f* is composed of a semicircular portion 60 and a semi-elliptic portion 61. The semi-elliptic portion 61 faces the inside of the coil spring 41. A major axis Y of the cross section of the wire 41*f* and axis X of the first spring 41 extend substantially at right angles to each other. If the first spring 41 is compressed along axis X, therefore, each two adjacent turns of the wire 41*f* contact each other on a plane (or a region indicated by Q in FIG. 10) along major axis Y. If the cross section of the wire 41*f* is oval, the area of the contact region Q is larger than that of the wire 41*a* with a circular cross section.

Thus, when some turns of the wire 41*f* are in contact with one another, the wire 41*f* cannot be easily dislocated, so that the characteristics of the first spring 41 are stabilized. If the cross section of the wire 41*f* is oval, moreover, stresses generated inside and outside the coil spring 41 are equalized when the spring 41 is compressed, so that the spring 41 can be favorably reduced in weight. Since other configurations and functions are common to the valve train 12 of the present embodiment (FIGS. 8 and 9) and the valve train 12 shown in FIGS. 3 and 4, common numerals are used to designate common portions of the two valve trains, and a repeated description of those portions is omitted.

Figure 11:
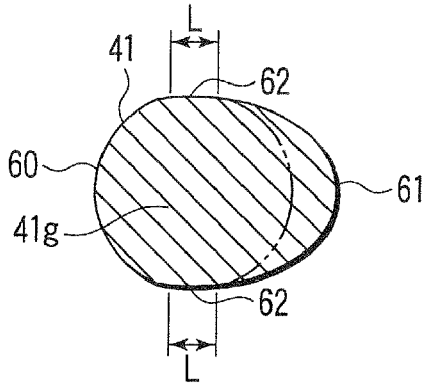
FIG. 11 is a sectional view showing a modification of the wire of the first spring.

FIG. 11 shows another wire 41*g* with an oval cross section. The cross section of the wire 41*g* is composed of a semicircular portion 60, a semi-elliptic portion 61, and flat portions 62 with a length L that connect the portions 60 and 61. Each two adjacent turns of the wire 41*g* face each other at each of the flat portions 62. Some turns of the wire 41*g* with this cross section contact one another at the flat portions 62 when the first spring 41 is compressed. Since the area of each contact region is further increased, therefore, the wire 41*g* cannot be easily dislocated, so that the characteristics of the first spring 41 are stabilized. the cross section of the wire of the first spring 41 may alternatively be rectangular.

Although the spring device of the present invention may be suitably applied to a valve train of an engine, it may also be applicable to any other devices than the valve train. It is to be understood in carrying out the invention that its components, including the valve, drive mechanism, and first and second springs, may be embodied in suitably modified forms without departing from the scope or spirit of the invention. For example, the second spring may be configured to be compressed before some turns of the wire of the first spring contact one another. Further, a coned-disc spring or wave washer may be used for the second spring.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A valve spring device which urges a valve attached to a port in a closing direction, the valve spring device comprising:

a first spring formed of a compression coil spring and deformable in an axial direction of the valve, wherein the first spring has a wire including portions which contact one another when an axial load acting in a direction to compress the first spring exceeds a predetermined value; and a second spring disposed in series with the first spring and held by a stopper in a manner such that the second spring is subjected to a preload by axial compression, wherein the preload of the second spring is larger than an installation load of the first spring, and wherein the valve spring device has load-deflection characteristics such that only the first spring deforms axially when the axial load acting in the direction to compress the first spring is not larger than the predetermined value, and such that both the first and second springs deform axially when the axial load exceeds the predetermined value.

2. The valve spring device according to claim 1, wherein the preload of the second spring is set so that the second spring deforms axially when the axial load exceeds a load under which all turns of the wire of the first spring closely contact one another.

3. The valve spring device according to claim 1, wherein the wire of the first spring has an oval cross section such that turns of the wire contact one another on surfaces along a major axis of the cross section.

4. The valve spring device according to claim 2, wherein the wire of the first spring has an oval cross section such that the turns of the wire contact one another on surfaces along a major axis of the cross section.

5. The valve spring device according to claim 1, wherein turns of the wire of the first spring individually have flat surface portions which contact one another.

6. The valve spring device according to claim 2, wherein the turns of the wire of the first spring individually have flat surface portions which contact one another.

7. A valve train of an engine, comprising:

a valve including a valve disc for opening and closing a port formed in a cylinder head;

a drive mechanism which drives the valve in an opening direction by means of a rotating cam; and a valve spring device which drives the valve in a closing direction, the valve spring device including:

a first spring, formed of a compression coil spring and deformable in an axial direction of the valve, and a second spring disposed in series with the first spring and held by a stopper in a manner such that the second spring is subjected to a preload by axial compression, wherein the preload of the second spring is larger than an installation load of the first spring, and wherein the valve spring device has load-deflection characteristics such that only the first spring deforms axially when an axial load which acts in a direction to compress the first spring is not larger than a predetermined value, and such that the first and second springs deform axially when the axial load exceeds the predetermined value, wherein the drive mechanism has a function to deform only the first spring axially and a function to deform both the first and second springs axially, and wherein the cam of the drive mechanism has a first cam surface which deforms only the first spring axially, thereby bringing at least some turns of a wire of the first spring into contact with one another, and a second cam surface which deforms the second spring axially with at least some turns of the wire of the first spring kept in contact with one another.

8. The valve train according to claim 7, wherein the drive mechanism includes a camshaft which rotates as the engine rotates and means for changing a lift of the valve in accordance with an output of the engine.

9. The valve train according to claim 7, wherein the drive mechanism includes:

a camshaft which rotates as the engine rotates, a first cam for low-output operation disposed on the camshaft, a second cam for high-output operation disposed on the camshaft, and switching means which causes one of the first and second cams to lift the valve in accordance with an output of the engine, wherein the first cam has a cam surface which deforms the first spring axially, and the second cam has a cam surface which deforms both the first and second springs axially, thereby making the lift of the valve larger than that of the first cam.

* * * * *